United States Patent [19]

Hayashi et al.

[11] Patent Number: 4,494,390

[45] Date of Patent: Jan. 22, 1985

[54] WASHING MACHINE

[75] Inventors: Gentaro Hayashi, Shiga; Kenji Yamamoto, Kusatsu; Takao Kuraseko, Otsu, all of Japan

[73] Assignee: Sanyo Electric Co., Ltd., Japan

[21] Appl. No.: 514,241

[22] Filed: Jul. 15, 1983

[30] Foreign Application Priority Data

Jul. 20, 1982 [JP] Japan ..... 57-127170

[51] Int. Cl.[3] ..... D06F 23/04; D06F 17/10

[52] U.S. Cl. ..... 68/23.7; 68/133; 68/134

[58] Field of Search ..... 68/23.6, 23.7, 133, 68/134

[56] References Cited

U.S. PATENT DOCUMENTS 1,753,521 4/1930 Labisky ..... 68/134
1,812,029 6/1931 Wilson ..... 68/134
2,042,578 6/1936 Behan ..... 68/134
2,303,719 12/1942 Berg ..... 68/134 X
2,334,859 11/1943 Beattie ..... 68/134

*Primary Examiner*—Philip R. Coe
*Attorney, Agent, or Firm*—Darby & Darby

[57] ABSTRACT

A washing machine having a cabinet, a basket mounted in the cabinet, and an agitator rotatably mounted on a bottom of the basket, which agitator has a substantially disk-shaped base, a projection in the form of a substantially triangular prism integrally extending from a substantially central portion of the base, and three vanes integrally extending smoothly from side ridges of the projection over the base. The projection has a height which is over ½ the outside diameter of the base and further has an upper end positioned below at least the level of water in the basket at the time the water is at rest. The agitator rotates at a speed of 300 rpm or less alternately clockwise and counterclockwise, to provide effective washing of clothes with less damage.

10 Claims, 11 Drawing Figures

WASHING MACHINE

BACKGROUND OF THE INVENTION

1. Field of the Invention

The present invention relates to a washing machine, and more particularly to a washing machine having an impeller mounted on the bottom of a basket or tub and rotatable for washing clothes.

2. Description of the Prior Art

There are known different types of washing machines in the art. One form of washing machine produces a spiral current of water in a basket or tub for washing clothes therein, while another washing machine type agitates water in the basket in washing operation.

The former type of washing machine employs an impeller disposed on the bottom of the basket and rotatable at a high speed for generating a spiral current of water in the basket to wash clothes therein. The impeller generally comprises a disk-shaped base, a projection integrally extending from the disk-shaped base, and a plurality of ridges or vanes integrally and smoothly extending from a barrel wall of the projection radially outwardly over the disk-shaped base. The projection has a height which is about 1/5–1/6 of the outside diameter of the disk-shaped base, so that the upper end of the projection is located far below the level of water in the basket, as shown in U.S. Pat. No. 3,306,082. The impeller usually rotates at a high speed in the range of from 400 to 800 rpm. The vortex of water produced in the basket during operation of the washing machine is strong enough to rotate the wash forcibly and clean the same, but so intensive that the clothes being washed tend to be damaged.

The washing machines for agitating water in the basket comprise an agitator having a height which is about 1.5 times greater than the outside diameter of a base of the agitator, the agitator having an upper end projecting upwardly beyond the level of water in the basket while the water is kept at rest. The agitator includes a plurality of relatively large ridges or vanes integrally formed on the base. In operation, the agitator oscillates about its own axis alternately clockwise and counterclockwise in an angular interval smaller than complete revolution for agitating water and clothes. U.S. Pat. No. 3,526,105 is representative of such a washing machine. The agitator turns in each cycle at a low speed of about 100 rpm. This type of washing machine is more advantageous than the impeller-type washing machine in that the wash is subject to less damage. However, with the agitator having a higher projection, upper and lower layers of clothes being washed do not switch around frequently, and thus are cleaned irregularly, that is, cannot be cleaned sufficiently.

SUMMARY OF THE INVENTION

It is an object of the present invention to provide a washing machine which will eliminate the foregoing prior difficulties.

According to the present invention, there is provided a washing machine comprising a cabinet, a basket mounted in the cabinet, an agitator rotatably mounted on a bottom of the basket, and drive means for rotating the agitator, the agitator being composed of a substantially disk-shaped base, a projection in the form of a substantially triangular prism integrally extending from a substantially central portion of the base, and three vanes integrally extending smoothly from side ridges of the projection over the base, the projection having a height which is about ½ of an outside diameter of the base and an upper end positioned below at least the level of water in the basket at the time the water is held at rest, the drive means comprising rotating means for rotating the agitator at a speed of 300 rpm or less and rotation switching control means for rotating the agitator alternately clockwise and counterclockwise.

With the arrangement of the present invention, the agitator having prescribed shape and dimensions is rotated at a given speed to wash clothes effectively while preventing the clothes from being damaged and cleaned irregularly.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
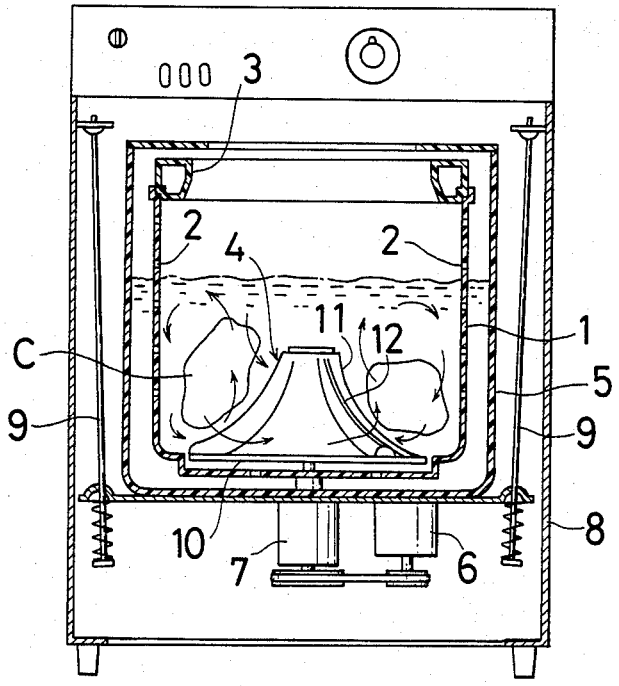
FIG. 1 is a schematic vertical cross-sectional view of a washing machine according to an embodiment of the present invention.

As shown in FIGS. 1 through 4, a washing machine comprises a perforate basket or tub 1 doubling as a centrifugal liquid extractor and having a multiplicity of perforations 2. A balance ring 3 is attached to an inlet opening edge of the perforate basket 1. The washing machine also includes an agitator or pulsator 4 rotatably mounted centrally on the bottom of the perforate basket 1. The perforate basket 1 is housed in an outer imperforate basket 5 supporting a drive motor 6 for rotating the basket 1 and the agitator 4, and a drive control mechanism 7 on the bottom thereof. The drive control mechanism 7 comprises a clutch for controlling rotations of the basket 1 and a brake for braking the basket rotation. The outer basket 5 is suspended by a plurality of rods 9 from a cabinet 8 of the washing machine so as to isolate unwanted vibrations.

Figure 3:
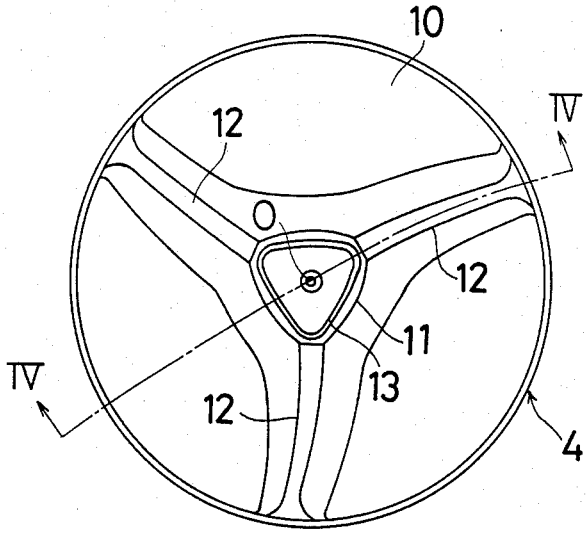
FIG. 3 is a plan view of an agitator.

The agitator 4 comprises a disk-shaped base 10, a projection 11 of substantially triangle cross section integrally extending upwardly from the center of the disk-shaped base 10, and a plurality of vanes (three in the illustrated embodiment) 12 integrally and smoothly extending from side ridges of the projection 11 onto the disk-shaped base 10. As illustrated in FIG. 3, the vanes 12 extend radially outwardly toward a circumferential edge of the disk-shaped base 10 and are curved gradually in one direction (clockwise as shown) to the radial base line. The projection 11 has a height (H) which is about ½ of the outside diameter (d) of the disk-shaped base 10 and lower than the level (h) of water contained in the basket 1. In the illustrated embodiment, the basket 1 has an inside diameter (D)=400 (mm), the disk-shaped base 10 has an outside diameter (d)=320 (mm), the projection 11 has a height (H)=140 (mm).

Figure 4:
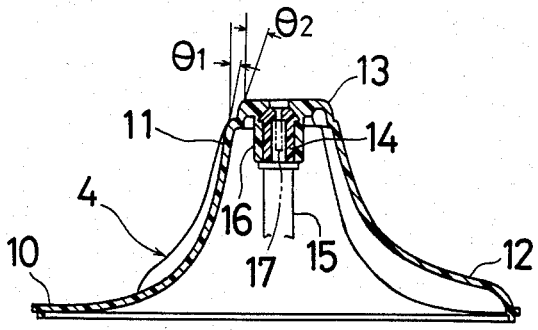
FIG. 4 is a cross-sectional view taken along line IV—O—IV of FIG. 3.

The projection 11 includes a top 13 in the form of a substantially triangular prism having a diameter smaller than that of the major portion of the projection 11. As shown in FIG. 4, the top 13 has a side shoulder surface inclined with respect to the vertical at an angle $\theta_2$ greater than the angle $\theta_1$ of inclination of a side shoulder surface of the major portion of the projection 11. In the illustrated embodiment, $\theta_2=12°$ and $\theta_1=8°$. A boss 14 is inserted in a boss 16 on the underside of the top 13 of the agitator 4 and fits over an upper end of an agitator shaft 15. The agitator 4 is attached to the agitator shaft 15 by an attachment screw 17 threaded into the upper portion of the agitator shaft 15. It is preferred that the top 13 have a height selected to be about ⅛–1/12 of that of the major portion of the projection 11. In the illustrated embodiment, the height of the top 13 is about 1/10 of that of the major portion of the projection 11.

Figure 2:
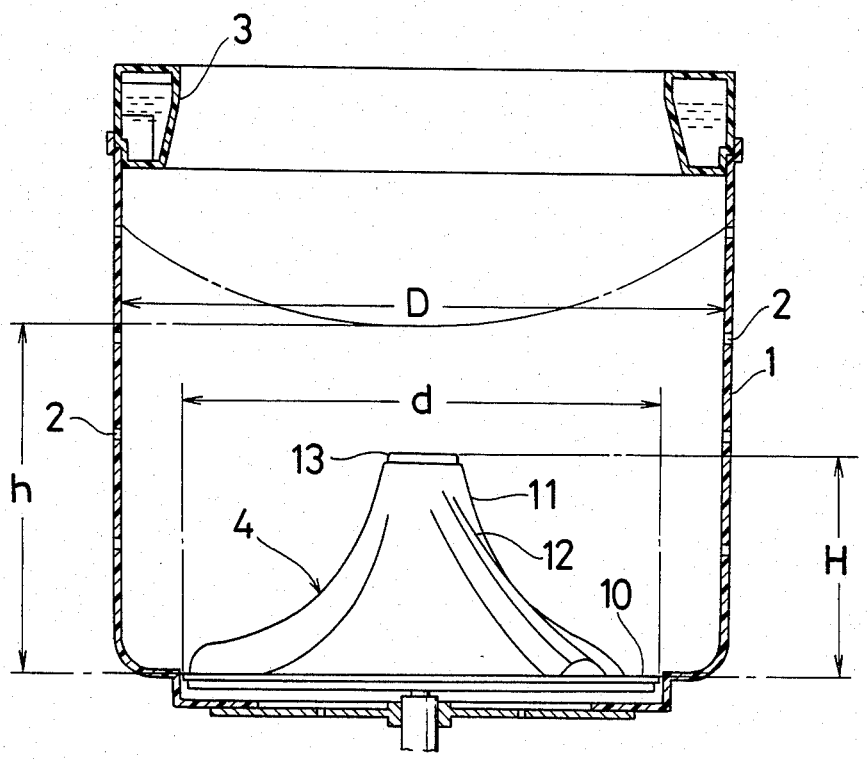
FIG. 2 is an enlarged vertical cross-sectional view of a portion of the washing machine shown in FIG. 1.

The agitator 4 is rotated alternately in clockwise and counterclockwise directions at a speed of 300 rpm or less which is lower than the speed of 400 rpm–800 rpm of conventional impellers. According to the illustrated embodiment, the agitator 4 rotates at about 180 rpm. In each cycle of operation, the agitator 4 rotates clockwise for 1 to 2 seconds, stops for 0.5 to 1 second, then rotates counterclockwise for 1 to 2 seconds, and finally stops for 0.5 to 1 second. The agitator 4 is operated in the reversible cycle such that the water level in the basket 1 as it is lowered or recessed centrally on rotation of the agitator 4 as shown in FIG. 2 will not become lower than the upper end of the projection 11.

When the basket 1 is loaded with water and clothes C, and the agitator 4 is rotated, the agitator 4 generates at its lower portion a stream of water tending to rotate the clothes C in a horizontal direction, and applies at a higher portion a force tending to move the clothes C up and down with the side surfaces of the triangular prism of the projection 11 and the vanes 12. As a consequence, the clothes C go down along the side wall of the basket 1 toward the agitator 4 in the directions of the arrows, and then go up along the projection 11, while the clothes C rotate horizontally.

Since the three vanes 12 are gradually curved clockwise to the radial base line as shown in FIG. 3, the currents of water generated during clockwise and counterclockwise directions differ from each other in intensity; the agitator 4 produces a stronger stream of water for pushing the clothes upwardly when it is rotated clockwise. More specifically, during clockwise rotation, the vanes 12 imposes a stronger force tending to cause the water to impinge upon the side wall of the basket 1, with the result that the water is moved as upward streams under reactive force from the side wall of the basket 1. As a result, the clothes move up and down for a greater interval.

Since the projection 11 is dimensioned so that it will be positioned below the level of water when the latter is held at rest, particularly, below the level of water when the latter is in rotation, the clothes C as it have moved up have a tendency of moving over and across the projection 11. However, the projection 11 being in the form of a triangular prism generates streams of water forcing the clothes C radially outwardly, thus preventing the clothes C from being entangled with the projection 11.

The smaller-diameter top 13 of the projection 11 coact with the larger-diameter major portion of the projection 11 in creating disturbances around the smaller-diameter top 13, giving the clothes C a greater tendency to be forced radially outwardly out of entangling engagement with the projection 11. Furthermore, since the angle $\theta_1$ of inclination of the upper side surface of the major portion of the projection 11 is smaller than the angle $\theta_2$ of inclination of the side surface of the top 13, the clothes C are likely to move over the projection 11 with more ease.

With conventional washing machines having agitators of increased height, clothes have been apt to get entangled with the agitator, and to avoid such a problem, the agitator has had to be rotated for 0.8 second and then stopped for 0.5 second in each cycle. Therefore, each cycle of operation of the agitator has heretofore been quite short. According to the embodiment of the invention, since any clothes being washed have a less tendency of becoming entangled with the projection 11, the cycle of operation of the agitator 4 is longer than that of prior agitators, with the results that the reverse contact of a timer and bearings have a longer service life, the motor is subject to a lower temperature rise, and the clothes can be cleaned more effectively. The clothes while being washed are free from undue pulling forces which would otherwise be caused by being entangled with the projection 11, and thus are subject to less damage.

The speed of rotation of the agitator 4 is lower than that of conventional impellers, also resulting in less damage to the clothes C. Nevertheless, the agitator 4 causes the clothes C to move up and down more actively than prior agitators, so that the clothes C can be cleaned evenly and effectively.

Figure 5:
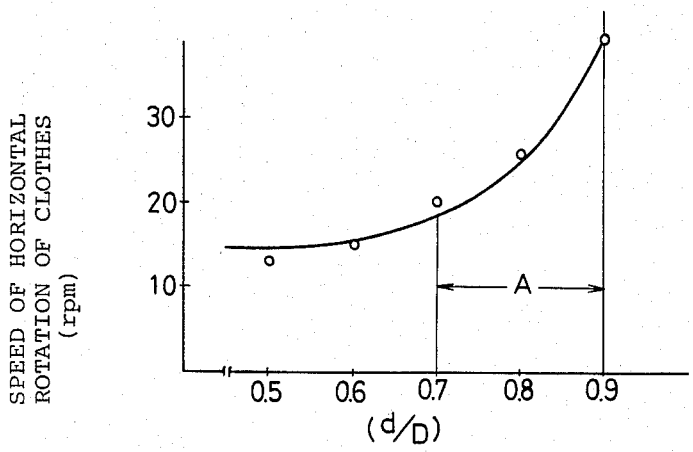
FIGS. 5 and 6 are graphs showing various characteristics plotted against dimensions of the agitator.
Figure 6:
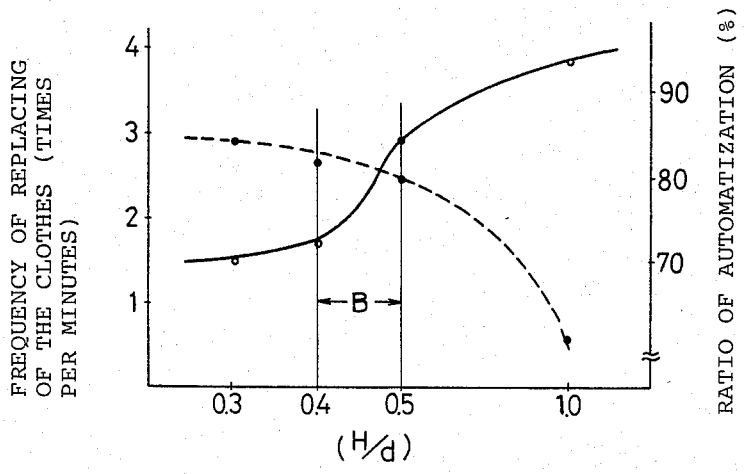
Figure 7:
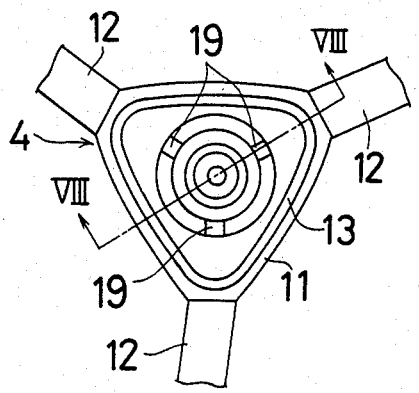
FIG. 7 is a fragmentary plan view of an agitator according to another embodiment of the present invention.
Figure 8:
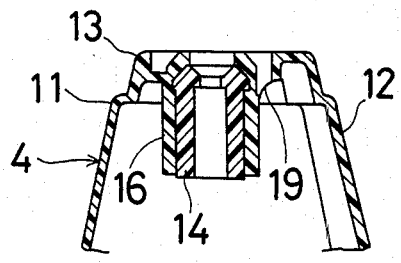
FIG. 8 is a cross-sectional view taken along line VIII—VIII of FIG. 7.
Figure 9:
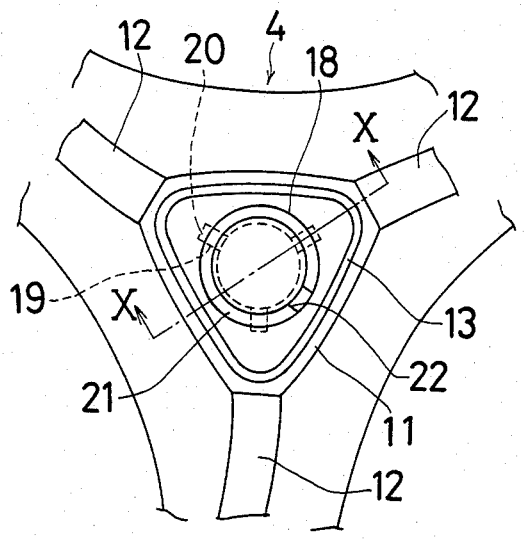
FIG. 9 is a plan view of the agitator of FIG. 7 with a cap attached.
Figure 10:
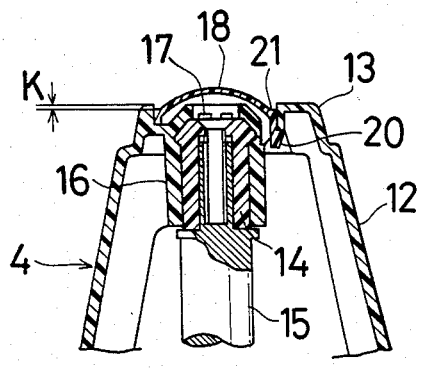
FIG. 10 is a cross-sectional view taken along line X—X of FIG. 9.
Figure 11:
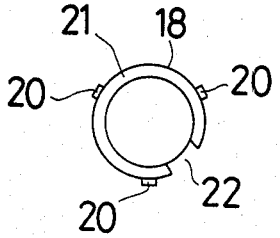
FIG. 11 is a plan view of the cap illustrated in FIG. 9.

The agitator 4 has been dimensioned on the basis of experimental data shown in FIGS. 5 and 6. FIG. 5 is a graph illustrative of the relationship between the speed of horizontal rotation of clothes C and the ratio of the diameter (d) of the disk-shaped base 10 to the inside diameter (D) of the basket 1. Study of the graph of FIG. 5 indicates that the greater the diameter (d) of the disk-shaped base 10, the faster the clothes rotate and the greater the efficiency with which the clothes can be cleaned. However, too a large outside diameter of the disk-shaped base 10 would reduce the mechanical strength of the basket 1. It is preferable that the diameter ratio d/D be in a range A of from 0.7 to 0.9. In the illustrated embodiment, the ratio d/D=0.8 as D=400 (mm) and d=320 (mm).

FIG. 6 is a graph showing the relationship between the ratio of the height (H) of the projection 11 to the diameter (d) of the disk-shaped base 10, the frequency of replacing of the clothes per minute between upper portion and lower portion in the basket (as shown by the dotted line), and the ratio of automatization (as shown by the solid line), that is, the ratio at which the washing machine operates without interruption until a final centrifugal water extraction step with no abnormal vibrations caused during centrifugal water extraction. The graph shows that the higher the projection 11, the smaller the frequency of replacing of the clothes and the larger the ratio of automatization as the clothes are uniformly distributed around the projection 11. The ratio H/d which achieves a desired frequency of replacing of the clothes and a desired automatization ratio at the same time has been found to be in a range B of from 0.4 to 0.5, that is, the height (H) of the projection 11 is about ½ of the diameter (d) of the disk-shaped base 10. In the illustrated embodiment, the ratio H/d is 0.44 as d=320 (mm) and H=140 (mm). The height of the projection 11 thus determined is such that the projection 11 will not project beyond the level of water in the basket 1. The data referred to above have been obtained in experiments in which the ratio of the weight of water to the weight of clothes in the basket is 10 at a rated load.

FIGS. 7 through 11 illustrate an agitator according to another embodiment of the present invention. An agitator 4 has a top 13 in the form of a substantially triangular prism and a cap 18 attached to the top 13 in covering relation to an attachment screw 17 for providing a sightly appearance. The cap 18 is mounted in position by fitting teeth 20 of the cap 18 resiliently in holes 19 defined in an upper surface of the top 13. The cap 18 has a central partly spherical portion and a horizontal flat portion 21 which is lower than the upper surface of the top 13 by a distance (K) (which is 0.5~1 mm for example). Since the horizontal flat portion 21 is lower than the upper surface of the top 13, the teeth 20 are prevented from being displaced off under forces acting during operation of the washing machine. The cap 18 can be pried off by inserting the tip of a screwdriver into a recess 22 in the cap 18.

With the embodiment of the present invention, the agitator 4 mounted on the bottom of the basket 1 is composed of the disk-shaped base 10, the projection 11 in the form of a substantially triangular prism integrally extending from the center of the disk-shaped base 10, and the three vanes 12 integrally extending smoothly from the side ridges of the projection 11 radially outwardly toward the outer peripheral edge of the base 10. The projection 11 has a height which is about ½ of the outside diameter of the disk-shaped base 10 so as not to project beyond the level of water in the basket. The agitator 4 is rotated alternately clockwise and counterclockwise at a low speed of 300 rpm or a lower speed. This arrangement reduces the impact of the agitator on the clothes being washed as compared with conventional washing machines in which spiral streams of water are produced during operation. With the projection 11 in the form of a triangular prism submerged in water, it produces disturbances tending to keep the clothes out of entangling engagement with the projection 11. Therefore, the clothes being washed are subject to less damage than that which would result from undue pulling forces due to entangling engagement with the agitator in the conventional washing machine.

The agitator causes the clothes to be rotated at its lower portion while allowing them to move up and down at its upper portion so that the clothes will move down the side wall of the basket toward the agitator and then up the projection while the clothes are being revolved horizontally around the projection. The clothes as they move up are prevented from being entangled with the projection and passing over and across the same easily due to the submerged projection in the form of the rectangular prism. The clothes move vertically as a whole for a large interval, are subject to less damage, and can be washed more evenly and effectively than could be by prior agitator-type washing machines.

Since the clothes tend to be less entangled with the projection, the agitator can be rotated in cycles longer than those in the conventional agitator-type washing machines, enabling the clothes to be cleaned more effectively. With this arrangement, the reverse contact of a timer and bearings undergo less wear, and the motor releases from its temperature being unnecessarily raised.

Although certain preferred embodiments have been shown and described, it should be understood that many changes and modifications may be made therein without departing from the scope of the appended claims.

What is claimed is:

1. A washing machine comprising a cabinet, a basket having a bottom, said basket being mounted in said cabinet, an agitator rotatably mounted on said bottom of said basket, and drive means for rotating said agitator, wherein said agitator is comprised of a substantially disk-shaped base having a predetermined outside diameter and an outer circumferential edge, a projection in the form of a substantially triangular prism having side ridges at the edges of said prism, integrally extending from a substantially central portion of said base, and three vanes integrally extending smoothly from said side ridges of said projection over said base, said projection having a height which is about ½ of said outside diameter and an upper end positioned below at least the level of water in said basket at the time the water is held at rest, said drive means comprising rotating means for rotating said agitator at a speed of 300 rpm or less and rotation switching control means for rotating said agitator alternately clockwise and counterclockwise.

2. A washing machine according to claim 1, wherein said three vanes are gradually curved in one direction with respect to linear radial lines extending from said central portion of said base.

3. A washing machine according to claim 2, wherein said projection comprises a major portion and a top portion integrally formed on an upper end of said major portion in coaxial relation, said top portion having a substantially triangular cross section smaller than that of said major projection, said top portion having a side shoulder inclined at a larger angle with respect to the vertical than an angle of inclination of a side shoulder of said major projection, said top portion having an upper end positioned below the level of water in said basket when said agitator is rotated.

4. A washing machine according to claim 1, wherein said upper end of said projection of said agitator is positioned below the level of water in said basket when said agitator is rotated.

5. A washing machine according to claim 1, wherein said projection comprises a major portion having an upper end and a side shoulder at said upper end and a top portion integrally formed on said upper end of said major portion in coaxial relation, said top portion having a substantially triangular cross section smaller than that of said major projection, said top portion having a side shoulder inclined at a first angle with respect to a longitudinal axis of said projection and said major portion side shoulder being inclined at a second angle with respect to said axis, said first angle being greater than said second angle.

6. A washing machine according to claim 5, wherein said top portion has a height ranging from ⅛ to 1/12 of that of said major portion.

7. A washing machine according to claim 1, wherein said three vanes integrally extend smoothly from said side ridges toward said outer circumferential edge of said base.

8. A washing machine according to claim 1, wherein said rotating means is capable of rotating said agitator at a speed of about 180 rpm.

9. A washing machine according to claim 8, wherein said rotation switching control means is capable of rotating said agitator clockwise for 1 to 2 seconds, stopping said agitator for 0.5 to 1 second, then rotating said agitator counterclockwise for 1 to 2 seconds, and finally stopping said agitator for 0.5 to 1 second in each cycle.

10. A washing machine according to claim 1, wherein said basket doubles as a centrifugal water extractor, said agitator being mounted centrally on the bottom of said basket.

* * * * *